US006986381B2

(12) United States Patent
Ray et al.

(10) Patent No.: US 6,986,381 B2
(45) Date of Patent: Jan. 17, 2006

(54) CASTINGS OF METALLIC ALLOYS WITH IMPROVED SURFACE QUALITY, STRUCTURAL INTEGRITY AND MECHANICAL PROPERTIES FABRICATED IN REFRACTORY METALS AND REFRACTORY METAL CARBIDES COATED GRAPHITE MOLDS UNDER VACUUM

(75) Inventors: Ranjan Ray, Phoenix, AZ (US); Donald W. Scott, Peoria, AZ (US)

(73) Assignee: Santoku America, Inc., Tolleson, AZ (US)

( * ) Notice: Subject to any disclaimer, the term of this patent is extended or adjusted under 35 U.S.C. 154(b) by 13 days.

(21) Appl. No.: 10/624,497

(22) Filed: Jul. 23, 2003

(65) Prior Publication Data

US 2005/0016706 A1 Jan. 27, 2005

(51) Int. Cl.

| | |
|---|---|
| ***B22C 9/00*** | (2006.01) |
| ***B22C 3/00*** | (2006.01) |
| ***B22D 13/00*** | (2006.01) |

(52) U.S. Cl. ..... 164/529; 164/72; 164/75; 164/459; 164/114; 164/4.1; 164/121; 164/122; 427/228; 148/555

(58) Field of Classification Search ..... 164/529, 164/72, 75, 459, 114, 4.1, 121, 122, 418; 427/228; 148/555

See application file for complete search history.

(56) References Cited

U.S. PATENT DOCUMENTS

| | | | |
|---|---|---|---|
| 2,977,222 | A | 3/1961 | Bieber |
| 3,241,200 | A | 3/1966 | Lirones |
| 3,243,733 | A | 3/1966 | Hosman |

(Continued)

FOREIGN PATENT DOCUMENTS

| | | |
|---|---|---|
| JP | 55149747 | 11/1980 |
| JP | 60040644 | 3/1985 |
| SU | 1306641 | 4/1987 |

OTHER PUBLICATIONS

U.S. Published Patent Application No. 2004/0003913 A1, (Ser. No. 10/143,920), Ray et al., filed May 14, 2002, published Jan. 8, 2004.

*Primary Examiner*—Kiley Stoner
*Assistant Examiner*—I.-H. Lin
(74) *Attorney, Agent, or Firm*—Stevens, Davis, Miller & Mosher, LLP

(57) ABSTRACT

Molds are fabricated having a substrate of high density, high strength ultrafine grained isotropic graphite, and having a mold cavity coated with a refractory metal such as W or Re or a refractory metal carbide such as TaC or HfC. The molds may be made by making the substrate (main body) of high density, high strength ultrafine grained isotropic graphite, by, for example, isostatic or vibrational molding, machining the substrate to form the mold cavity, and coating the mold cavity with titanium carbide via either chemical deposition or plasma assisted chemical vapor deposition, magnetron sputtering or sputtering. The molds may be used to make various metallic alloys such as nickel, cobalt and iron based superalloys, stainless steel alloys, titanium alloys and titanium aluminide alloys into engineering components by melting the alloys in a vacuum or under a low partial pressure of inert gas and subsequently casting the melt in the graphite molds under vacuum or low partial pressure of inert gas.

26 Claims, 1 Drawing Sheet

Figure 1:
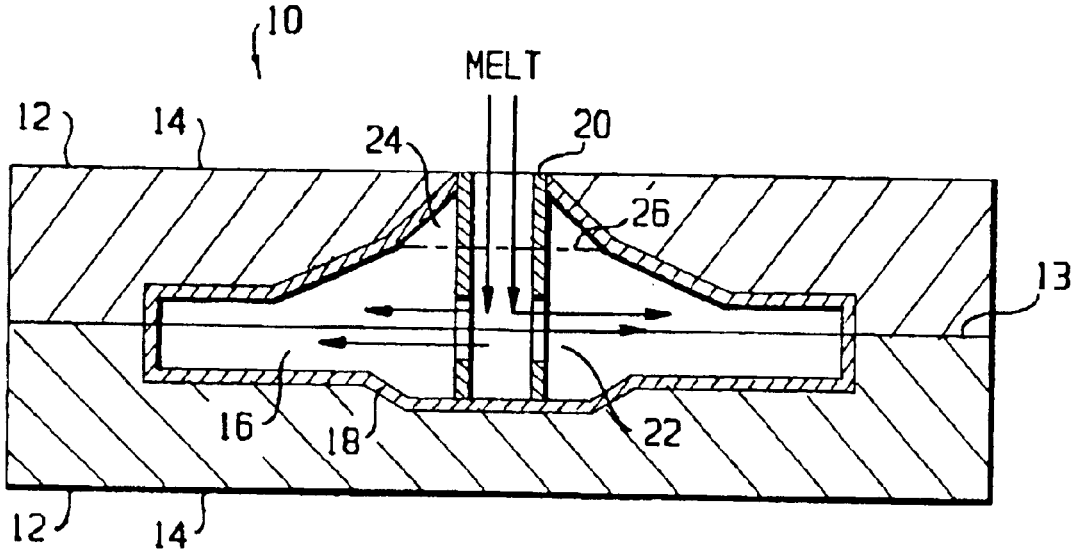

U.S. PATENT DOCUMENTS 3,256,574 A 6/1966 Lirones
3,257,692 A 6/1966 Operhall
3,265,574 A 8/1966 Scolari
3,266,106 A 8/1966 Lirones
3,296,666 A 1/1967 Lirones
3,321,005 A 5/1967 Lirones
3,389,743 A 6/1968 Morozov et al.
3,485,288 A 12/1969 Zusman et al.
3,492,197 A 1/1970 Olstowski et al.
3,519,503 A 7/1970 Moore et al.
3,547,676 A 12/1970 Bokros et al.
3,567,896 A 3/1971 Chang
3,683,996 A 8/1972 Dunlop
3,718,720 A 2/1973 Lambdin, Jr. et al.
3,781,158 A 12/1973 Leghorn
3,802,902 A 4/1974 Turner, Jr. et al.
3,900,540 A 8/1975 Robba et al.
4,005,163 A 1/1977 Bokros
4,129,462 A 12/1978 Korenko
4,209,348 A 6/1980 Duhl et al.
4,226,900 A 10/1980 Carlson et al.
4,453,985 A 6/1984 Gessinger et al.
4,574,015 A 3/1986 Genereux et al.
4,579,602 A 4/1986 Paulonis et al.
4,608,192 A 8/1986 Su
4,612,062 A 9/1986 Nazmy et al.
4,627,945 A 12/1986 Winkelbauer et al.
4,670,201 A 6/1987 Montgomery et al.
4,719,080 A 1/1988 Duhl et al.
4,761,272 A 8/1988 Hucke
4,769,087 A 9/1988 Genereux et al.
5,026,521 A 6/1991 Kajimura et al.
5,163,498 A 11/1992 Kantner et al.
5,176,762 A 1/1993 Berczik
5,226,946 A 7/1993 Diehm et al.
5,439,744 A 8/1995 Claar et al.
5,489,411 A 2/1996 Jha et al.
5,525,276 A 6/1996 Okuyama et al.
5,630,465 A 5/1997 Feagin
5,665,262 A 9/1997 Hajaligol et al.
5,705,139 A 1/1998 Stiller et al.
5,924,470 A 7/1999 Costilla-Vela et al.
5,964,091 A 10/1999 Fukui et al.
6,113,982 A * 9/2000 Claar et al. ..... 427/248.1
6,250,366 B1 6/2001 Choudhury et al.
6,360,809 B1 * 3/2002 Cornie et al. ..... 164/65
6,408,929 B2 6/2002 Choudhury et al.
6,572,815 B1 6/2003 Ju et al.
6,634,413 B2 10/2003 Ray et al.
6,705,385 B2 * 3/2004 Ray et al. ..... 164/529
6,755,239 B2 6/2004 Ray et al.
6,776,214 B2 8/2004 Ray et al.

* cited by examiner

CASTINGS OF METALLIC ALLOYS WITH IMPROVED SURFACE QUALITY, STRUCTURAL INTEGRITY AND MECHANICAL PROPERTIES FABRICATED IN REFRACTORY METALS AND REFRACTORY METAL CARBIDES COATED GRAPHITE MOLDS UNDER VACUUM

I. FIELD OF THE INVENTION

The invention relates to methods for making various metallic alloys such as nickel, cobalt and iron based superalloys, stainless steel alloys, nickel aluminides, titanium and titanium aluminide alloys, as well as zirconium base alloys into engineering components by melting of the alloys in a vacuum or under a low partial pressure of inert gas and subsequent casting of the melt under vacuum or under a low pressure of inert gas in molds machined from fine grained high density, high strength isotropic graphite wherein the mold cavity is uniformly coated with a thin layer of dense, hard and wear resistant coating of a refractory metal such as tungsten or rhenium or a refractory metal carbide such as tantalum carbide or hafnium carbide.

II. BACKGROUND OF THE INVENTION

A. Invention Casting

If a small casting, from ½ oz to 20 lb (14 g to 9.1 kg (mass)) or today even over 100 lb (45 kg), with fine detail and accurate dimensions is needed, lost wax investment casting is considered. This process is used to make jet engine components, fuel pump parts, levers, nozzles, valves, cams, medical equipment, and many other machine and device parts. The investment casting is especially valuable for casting difficult-to-machine metals such as superalloys, stainless steel, high-nickel alloys and titanium alloys.

The process is slow and is one of the most expensive casting processes. If a design is changed, it may require expensive alterations to a metal die (as it would in die casting also).

Preparation of investment casting molds requires operation of several equipment involving many manual processing steps such as the following.

(a) Fabrication of wax patterns via injection molding equipment, (b) manual assembly of wax patterns, (c) dipping wax patterns in six to nine different alumina or zirconia ceramic slurries contained in large vats, (d) dewaxing the molds in autoclave, and (e) preheating the molds to 2000° F. in a furnace prior to vacuum casting.

Wax injection pattern dies are expensive depending on the intricacy of the part. Lead time of six to twelve months for the wax injection die is common in the industry. Defects often occur in wax patterns due to human errors during fabrication. These defects are frequently repaired manually, which is a time consuming process.

Ceramic molds are cracked frequently during dewaxing, that leaves a positive impression on the castings, which requires manual repair.

Ceramic facecoat applied after the first dip of the wax patterns in the ceramic slurry tends to spall or crack which often get trapped as undesirable inclusions in the final castings. Ceramic facecoat would react with rare earth elements in the superalloy, such as yttrium, cerium, hafnium, etc., which may cause a deviation of the final chemistry of the castings from the required specifications.

Investment castings are removed from the mold by breaking the molds and sometime by leaching the molds in hot caustic bath followed by grit blasting. These steps additionally increase the cost of production.

B. Ceramic-Mold Processes

If long-wearing, accurate castings of tool steel, cobalt alloys, titanium, or stainless steel are desired, ceramic molds are often used instead of sand molds.

The processes use conventional patterns of ceramic, wood, plastic, or metal such as steel; aluminum and copper set in cope and drag flasks. Instead of sand, a refractory slurry is used. This is made of a carefully controlled mixture of ceramic powder with a liquid catalyst binder (an alkyl silicate). Various blends are used for specific metal castings. Ceramic molds are used only one time and are expensive.

There is a need for improving the molding of various metallic alloys such as nickel, cobalt and iron based superalloys, nickel aluminides, stainless steel alloys, titanium alloys, titanium aluminide alloys, zirconium and zirconium base alloys. Metallic superalloys of highly alloyed nickel, cobalt, and iron based superalloys are difficult to fabricate by forging or machining. Moreover, conventional investment molds and ceramic molds are used only one time for fabrication of castings of metallic alloys such as nickel, cobalt and iron based superalloys, stainless steel alloys, titanium alloys and titanium aluminide alloys. This increases the cost of production.

The term superalloy is used in this specification in its conventional sense and describes the class of alloys developed for use in high temperature environments and typically having a yield strength in excess of 100 ksi at 1000° F. Nickel base superalloys are widely used in gas turbine engines and have evolved greatly over the last 50 years. As used herein the term superalloy will mean a nickel base superalloy containing a substantial amount of the γ' (gamma prime) ($Ni_3Al$) strengthening phase, preferably from about 30 to about 50 volume percent of the gamma prime phase. Representative of such class of alloys include the nickel base superalloys, many of which contain aluminum in an amount of at least about 5 weight % as well as one or more of other alloying elements, such as titanium, chromium, tungsten, tantalum, etc. and which are strengthened by solution heat treatment. Such nickel base superalloys are described in U.S. Pat. No. 4,209,348 to Duhl et al. and U.S. Pat. No. 4,719,080 incorporated herein by reference in their entirety. Other nickel base superalloys are known to those skilled in the art and are described in the book entitled "Superalloys II" Sims et al., published by John Wiley & Sons, 1987, incorporated herein by reference in its entirety.

Other references incorporated herein by reference in their entirety and related to superalloys and their processing are cited below:

"Investment-cast superalloys challenge wrought materials" from Advanced Materials and Process, No. 4, pp. 107–108 (1990).

"Solidification Processing", editors B. J. Clark and M. Gardner, pp. 154–157 and 172–174, McGraw-Hill (1974).

"Phase Transformations in Metals and Alloys", D. A. Porter, p. 234, Van Nostrand Reinhold (1981).

Nazmy et al., The effect of advanced fine grain casting technology on the static and cyclic properties of IN713LC, Conf: High temperature materials for power engineering 1990, pp. 1397–1404, Kluwer Academic Publishers (1990).

Bouse & Behrendt, Mechanical properties of Microcast-X alloy 718 fine grain investment castings, Conf: Superalloy 718: Metallurgy and applications, Publ:TMS pp. 319–328 (1989).

Abstract of U.S.S.R. Inventor's Certificate 1306641, published Apr. 30, 1987.

WPI Accession No. 85-090592/85 & Abstract of JP 6040644 (KAWASAKI), published Mar. 4, 1985.

WPI Accession No. 81-06485D/81 & Abstract of JP 55-149747 (SOGO), published Nov. 21, 1980.

Fang, J; Yu, B, Conference: High Temperature Alloys for Gas Turbines, 1982, Liege, Belgium, Oct. 4–6, 1982, pp. 987–997, Publ: D. Reidel Publishing Co., P.O. Box 17, 3300 AA Dordrecht, The Netherlands (1982).

Processing techniques for superalloys have also evolved as evident from the following references incorporated herein by reference in their entirety. Many of the newer processes are quite costly.

U.S. Pat. No. 3,519,503 describes an isothermal forging process for producing complex superalloy shapes. This process is currently widely used, and as currently practiced requires that the starting material be produced by powder metallurgy techniques.

The reliance on powder metallurgy techniques makes this process expensive.

U.S. Pat. No. 4,574,015 deals with a method for improving the forgeability of superalloys by producing overaged microstructures in such alloys. The gamma prime phase particle size is greatly increased over that which would normally be observed.

U.S. Pat. No. 4,579,602 deals with a superalloy forging sequence that involves an overage heat treatment.

U.S. Pat. No. 4,769,087 describes another forging sequence for superalloys.

U.S. Pat. No. 4,612,062 describes a forging sequence for producing a fine grained article from a nickel base superalloy.

U.S. Pat. No. 4,453,985 describes an isothermal forging process that produces a fine grain product.

U.S. Pat. No. 2,977,222 describes a class of superalloys.

Since, the introduction of titanium and titanium alloys in the early 1950's, these materials have found widespread uses in aerospace, energy, and chemical industries. The combination of high strength-to-weight ratio, excellent mechanical properties, and corrosion resistance makes titanium the best material for many critical applications. Titanium alloys are used for static and rotating gas turbine engine components. Some of the most critical and highly stressed civilian and military airframe parts are made of these alloys.

The use of titanium has expanded in recent years from applications in food processing plants, from oil refinery heat exchangers to marine components and medical prostheses. However, the high cost of titanium alloy components may limit their use. The relatively high cost is often fabricating costs, and, usually most importantly, the metal removal costs incurred in obtaining the desired end-shape. As a result, in recent years a substantial effort has been focused on the development of net shape or near-net shape technologies such as powder metallurgy (PM), superplastic forming (SPF), precision forging, and precision casting. Precision casting is by far the most fully developed and the most widely used net shape technology. Titanium castings present certain advantages. The microstructure of as-cast titanium is desirable for many mechanical properties.

The properties of titanium castings are generally comparable to wrought products in all respects and quite often superior. Properties associated with fatigue crack propagation and creep resistance can be superior to those of wrought products. As a result, titanium castings can be cost competitive with the forged and machined parts in many demanding applications. Titanium undergoes (alpha+beta) to beta allotropic phase transformation at a temperature range of 705° C. to 1040° C. well below the solidification temperature of the alloys. As a result, the cast dendritic beta structure is eliminated during the solid state cooling stage, leading to an (alpha+beta) platelet structure similar to typical wrought alloy. Further, the as-cast microstructure can be improved by means of post-cast cooling rate changes and subsequent heat treatment Titanium castings respond well to the process of elimination of porosity of internal casting defects by hot isostatic pressing (HIP). Both elimination of casting porosity and promotion of a favorable microstructure improve mechanical properties. However, the high reactivity of titanium, especially in the molten state, presents a special challenge to the foundry. Special, and sometimes relatively expensive, methods of melting, mold making, and surface cleaning may be required to maintain metal integrity.

Lost wax investment molding was the principal technology that allowed the proliferation of production of titanium casting. The adaptation of this method to titanium casting technology required the development of ceramic slurry materials having minimum reaction with the extremely reactive molten titanium.

The titanium casting industry is still in its early stage of development. Because of highly reactive characteristics of titanium with ceramic materials, expensive mold materials (yttrium, throc and zircon) are used to make investment molds for titanium castings. The titanium castings develop a contaminated surface layer due to reaction with hot ceramic mold and molten titanium. This surface layer needs to be removed by some expensive chemical milling in acidic solutions containing hydrofluoric acid. Strict EPA regulations have to be followed to pursue chemical milling.

For example, U.S. Pat. No. 5,630,465 to Feagin discloses ceramic shell molds made from yttria slurries, for casting reactive metals. This patent is incorporated herein by reference.

The use of graphite in investment molds has been described in U.S. Pat. Nos. 3,241,200; 3,243,733; 3,256,574; 3,266,106; 3,296,666 and 3,321,005 all to Lirones and all incorporated herein by reference. U.S. Pat. Nos. 3,257,692 to Operhall; 3,485,288 to Zusman et al.; and 3,389,743 to Morozov et al. disclose carbonaceous mold surface utilizing graphite powders and finely divided inorganic powders termed "stuccos" and are incorporated herein by reference.

U.S. Pat. No. 4,627,945 to Winkelbauer et al., incorporated herein by reference, discloses injection molding refractory shroud tubes made from alumina and from 1 to 30 weight percent calcined fluidized bed coke, as well as other ingredients. The '945 patent also discloses that it is known to make isostatically-pressed refractory shroud tubes from a mixture of alumina and from 15 to 30 weight percent flake graphite, as well as other ingredients.

III. PREFERRED OBJECTS OF THE PRESENT INVENTION

It is an object of the invention to cast alloys in isotropic graphite molds with the mold cavity coated with a thin layer of dense, hard and wear resistant coating of a refractory metal such as tungsten or rhenium or a refractory metal carbide such as tantalum carbide or hafnium carbide.

It is another object of the present invention to cast nickel, cobalt and nickel-iron base superalloys in isotropic graphite molds with the mold cavity coated with a thin layer of dense, hard and wear resistant coating of a refractory metal such as tungsten or rhenium or a refractory metal carbide such as tantalum carbide or hafnium carbide.

It is another object of the present invention to cast nickel aluminide alloys in isotropic graphite molds with the mold cavity coated with a thin layer of dense, hard and wear resistant coating of a refractory metal such as tungsten or rhenium or a refractory metal carbide such as tantalum carbide or hafnium carbide.

It is another object of the present invention to cast stainless steels in isotropic graphite molds with the mold cavity coated with a thin layer of dense, hard and wear resistant coating of a refractory metal such as tungsten or rhenium or a refractory metal carbide such as tantalum carbide or hafnium carbide.

It is another object of the present invention to cast titanium and titanium alloys in isotropic graphite molds with the mold cavity coated with a thin layer of dense, hard and wear resistant coating of a refractory metal such as tungsten or rhenium or a refractory metal carbide such as tantalum carbide or hafnium carbide.

It is another object of the present invention to cast titanium aluminides in isotropic graphite molds with the mold cavity coated with a thin layer of dense, hard and wear resistant coating of a refractory metal such as tungsten or rhenium or a refractory metal carbide coating such as tantalum carbide or hafnium carbide.

It is another objective of the present invention to cast zirconium and zirconium aluminide alloys isotropic graphite molds with the mold cavity coated with a thin layer of dense, hard and wear resistant coating of a refractory metal such as tungsten or rhenium or a refractory metal carbide such as tantalum carbide or hafnium carbide.

It is another objective of the present invention to cast aluminum matrix composites reinforced with a high volume fraction of particulates and/or whiskers of one or more of compounds such as silicon carbide, aluminum titanium carbide and titanium diboride in isotropic graphite molds with the mold cavity coated with a thin layer of dense, hard and wear resistant coating of a refractory metal such as tungsten or rhenium or a refractory metal carbide such as tantalum carbide or hafnium carbide.

It is another object of the present invention to provide isotropic graphite molds with the mold cavity coated with a thin layer of dense, hard and wear resistant coating of a refractory metal such as tungsten or rhenium or a refractory metal carbide such as tantalum carbide or hafnium carbide.

These and other objects of the present invention will be apparent from the following description.

IV. SUMMARY OF THE INVENTION

This invention relates to a process for making various metallic alloys such as nickel, cobalt and iron based superalloys, stainless steel alloys, titanium alloys, titanium aluminide alloys, zirconium alloys and zirconium aluminide alloys as engineering components by vacuum induction melting of the alloys and subsequent casting of the melt in graphite molds under vacuum. More particularly, this invention relates to the use of high density high strength isotropic graphite molds with the mold cavity having been coated with a thin layer of dense, hard and wear resistant coating of a refractory metal such as tungsten or rhenium or a refractory metal carbide such as tantalum carbide or hafnium carbide. Refractory metal (W or Re) or refractory metal carbide (TaC or HfC) coating is produced on the cavity of graphite mold via one of the processes such as the chemical vapor deposition (CVD), sputtering, magnetron-sputtering or plasma assisted chemical vapor deposition techniques. Coatings of refractory metals such as tungsten or rhenium or refractory metal carbides such as tantalum carbide or hafnium carbide produced by one of the above mentioned processes have very high purity (containing negligible trace elements).

The invention relates to refractory metal (W or Re) or refractory metal carbide (TaC or HfC) coating on bulk isotropic graphite that acts as the main body of the mold.

In particular the invention relates to a method of making cast shapes of a metallic alloy, comprising the steps of:

melting the alloy to form a melt under vacuum or partial pressure of inert gas;

pouring the melt of the alloy into the cavity of a composite mold which is made essentially of isotropic graphite having a machined mold cavity, wherein the surface of the mold cavity is coated with a thin layer of dense, hard and wear resistant coating of a refractory metal such as tungsten or rhenium or a refractory metal carbide such as tantalum carbide or hafnium carbide.

The range of typical properties of W, Re, TaC and HfC are given below.

Low coefficient of friction

Thermal conductivity @ 20 degrees Celsius: 0.41 to 0.53 ca/s-cm-degree C.

Linear Thermal Expansion: about 0.02% to 0.027% @ 600° F. and about 0.8% to 0.9% @ 2000° F.

Flexural Strength: about 40,000 psi to 75,000 psi @ 70° F. and about 15,000 psi to 35,000 psi @ 2000° F.

Vickers Hardness: 2200 to 3500 HV

Melting Point: 5756° F. to 7034° F.

To construct a typical composite mold of the present invention, a mold with split halves is fabricated out of a high density isotropic graphite by machining a mold cavity of the required design into the graphite. Subsequently, the mold cavity is coated with a thin layer of dense, hard and wear resistant coating of a refractory metal such as tungsten or rhenium or a refractory metal carbide coating such as tantalum carbide or hafnium carbide via one of the processes such as the chemical vapor deposition (CVD), sputtering, magnetron-sputtering or plasma assisted chemical vapor deposition techniques.

Moreover, the above described composite molds, i.e., isotropic graphite molds coated with a thin layer of dense, hard and wear resistant coating of a refractory metal such as tungsten or rhenium or a refractory metal carbide such as tantalum carbide or hafnium carbide, can be used to fabricate castings of superalloys, stainless steels, titanium alloys, titanium aluminides, nickel aluminides and zirconium alloys with improved quality and superior mechanical properties compared to castings made by a conventional investment casting process.

The molds can be used repeatedly many times thereby reducing significantly the cost of fabrication of castings compared to traditional processes.

Near net shape parts can be cast, eliminating subsequent operating steps such as machining.

As discussed above, the composite mold is made by a process including machining a cavity into a monolithic block of isotropic graphite and then coating at least the surface of the cavity with a thin layer of dense, hard and wear resistant refractory metal such as tungsten or rhenium or refractory metal carbide such as tantalum carbide or hafnium carbide. In the alternative, the isotropic graphite substrate can be initially molded to have the cavity and then have at least the surface of the cavity coated with a thin layer of dense, hard and wear resistant refractory metal such as tungsten or rhenium or a refractory metal carbide such as tantalum carbide or hafnium carbide.

If desired, the composite mold may include a first substrate layer, a second substrate layer located over the first substrate layer and defining a cavity, and a thin layer of dense, hard and wear resistant coating of a refractory metal such as tungsten or rhenium or a coating of a refractory metal carbide such as tantalum carbide or hafnium carbide forming over at least the cavity of the second substrate layer. The second substrate layer would consist essentially of isotropic graphite. The first substrate layer may be made of any material which does not significantly interfere with operation of the mold. For example, a potential material for the first substrate layer may be extruded graphite.

Construction of composite graphite molds according to the present invention is economical.

The mold of an isotropic graphite substrate coated with a thin layer of dense, hard and wear resistant coating of a refractory metal such as tungsten or rhenium or a refractory metal carbide such as tantalum carbide or hafnium carbide would be more long lasting and perform better than a mold made of an extruded graphite substrate coated with a thin layer of dense, hard and wear resistant coating of a refractory metal such as tungsten or rhenium or a refractory metal carbide such as tantalum carbide or hafnium carbide.

V. BRIEF DESCRIPTION OF THE DRAWING

The sole FIGURE shows a schematic of an embodiment of a mold of the present invention.

VI. DETAILED DESCRIPTION OF THE PREFERRED EMBODIMENTS

A. Graphite Molds

The sole FIGURE shows an embodiment of a composite graphite mold 10 of the present invention. The mold 10 has two halves 12. The border between the two halves 12 is shown as a parting line 13. Each half 12 made of a substrate 14 of isotropic graphite with a machined mold cavity 16 onto which a thin layer of dense, hard and wear resistant coating of a refractory metal such as tungsten or rhenium or a coating of a refractory metal carbide such as tantalum carbide or hafnium carbide 18 is deposited. The coating thickness is maintained from 2 microns to 500 microns, preferably 7 to 100 microns, and more preferably 10 to 25 microns. As shown, a thin layer of dense, hard and wear resistant coating of a refractory metal such as tungsten or rhenium or a refractory metal carbide such as tantalum carbide or hafnium carbide 18 is directly deposited onto the isotropic graphite substrate 14. The mold 10 also has a core 20. The core 20 is an isotropic graphite cylinder. The core 20 has holes 22 (also known as a gate) for flowing the alloy "MELT" there through into the cavity 16. Molten metal shrinks as it cools. Thus, the mold 10 has a riser section 24 for excess metal. After the metal cools the excess metal is removed to the dashed line 26 by cutting or other appropriate machining.

1. Coating Processes

In the chemical vapor deposition (CVD) process, the refractory metal or refractory metal carbide coatings on graphite substrates (molds) are formed in a reaction chamber (retort) at an elevated temperature (1700–1900 degrees Fahrenheit). The process gases (Refractory Metal Tetrachlorides, Hydrocarbons, Hydrogen and/or Nitrogen) react with the graphite substrate to form the desired coating. The coating thickness ranges from 2 to 500 microns thick.

Lower process temperatures are possible with the PACVD process (Plasma Assisted CVD). In this process the gas/substrate system is exposed to a low-temperature plasma that supplies the necessary energy to activate the reaction. The process temperatures used in PACVD lie between 700–1200° F.

In a sputtering process, a sputtering target having the composition of the final coatings such as W, Re, TaC or HfC is used as a source. The coating is deposited on the graphite substrates (mold cavities) by the sputtering technique in a vacuum chamber, generally a magnetron is applied to enhance the deposition rate. Based on the good electrical conductivity of the graphite, direct current (DC) or radio frequency (RF) at 10 to 20 MHz can be applied for the plasma excitation that will enhance the bonding of the sputtered refractory metals (W or Re) or refractory metal carbides (TaC or HfC) on graphite substrates. Typically, the sputter deposition process is carried out between room temperature and 10001F.

Sputtering is performed in a vacuum chamber, which is pumped down by a series of mechanical and high vacuum pump, to a pressure below 5×10–7 Torr. The chamber is then backfilled with a sputtering gas to a pressure of millitorr range so as to provide a suitable medium in which a glow discharge can be initiated and maintained to continuously supply the bombarding particles. Argon gas is generally used because its large atomic mass led to good sputtering yield and it is low in cost The target having the composition of the coating is placed into the vacuum chamber together with graphite substrates. The substrates are usually placed in front of the target. The target is connected to a negative voltage supply, which can be either DC or RF. The substrates can be grounded, floating, biased or heated.

The sputtering process is initiated by applying a negative potential to the target. When the voltage exceeds a threshold value, stable glow discharge appears. In the presence of negative potential, free electrons are accelerated and ionized the argon gas atoms. A mixture of positively charged argon ions and negatively charged electrons, or plasma is thus formed in between the target and the substrate. The target with a negative potential attracted the positive argon ions.

The sputtered molecules of refractory metals or refractory metal carbides are scattered in random directions, and some of them land on the substrate, condense there, and form a thin film layer.

In general, magnetron sputtering systems, magnetic fields are used together with the cathode surface to form electron traps. A magnetic field is formed on the target by placing magnets on the back of the target. The magnetic field causes the electrons to follow a longer helical path near the target surface thus increasing the ionization of the argon gas. This allows lower pressures and voltages to be used while achieving high deposition rate.

2. Isotropic Graphite

Isotropic graphite is the preferred material as the main body (substrate) of the composite mold of the present invention for the following reasons.

Isotropic graphite made via isostatic pressing has fine grains (3–40 microns) whereas extruded graphite is produced from relative coarse carbon particles resulting in coarse grains (400–1200 microns). Isotropic fine grained graphite has much higher strength, and structural integrity than extruded graphite due to the presence of fine grains, higher density and lower porosity.

Isotropic fine grained graphite can be machined with a very smooth surface compared to extruded graphite due to its high hardness, fine grains and low porosity. A thin layer of dense and hard coating of a refractory metal such as tungsten or rhenium or a refractory metal carbide such as tantalum carbide or hafnium carbide deposited over an extremely smooth machined surface of isotropic graphite will have a very smooth finish with uniform thickness and will be desirable for producing castings of superalloys and titanium.

References relating to isotropic graphite include U.S. Pat. Nos. 4,226,900 to Carlson, et al, 5,525,276 to Okuyama et al, and 5,705,139 to Stiller, et al., all incorporated herein by reference.

The isotropic graphite of the main body (substrate) of the mold is typically high density ultrafine grained graphite, and is of very high purity (containing negligible trace elements). It is typically made via the isostatic pressing route. Typically, the isotropic graphite of the main body has been isostatically or vibrationally molded and has ultra fine isotropic grains between 340 microns, a density between 1.65–1.9 grams/cc (preferably 1.77–1.9 grams/cc), flexural strength between 5,500 and 20,000 psi (preferably between 7,000 and 20,000 psi), compressive strength between 12,000 and 35,000 psi (preferably between 17,000 and 35,000 psi), and porosity below 15% (preferably below 13%).

Other important properties of the isotropic graphite material are high thermal shock, wear and chemical resistance, and minimum wetting by liquid metal.

In contrast, extruded graphite which has lower density (<1.72 gm/cc), lower flexural strength (<3,000 psi), high porosity (>20%), and lower compressive strength (<8,000 psi) has been found to be less suitable as molds for casting iron, nickel and cobalt base superalloys.

Also, isotropic graphite made via isostatic pressing has fine grains (3–40 microns) whereas extruded graphite is produced from relative coarse carbon particles resulting into coarse grains (400–1200 microns). Isotropic graphite has much higher strength, and structural integrity than extruded graphite due to the presence of extremely fine grains, higher density and lower porosity, as well as the absence of "loosely bonded" carbon particles. Extruded graphite has higher thermal conductivity due to anisotropic grain structure formed during extrusion.

Another premium grade of graphite suitable for use as the main body for permanent molds for casting various superalloys, titanium and titanium aluminide alloys with high quality is a copper impregnated "isotropic" graphite, R8650C from SGL Graphite Company. It has excellent density, microfine grain size and can be machined/ground to an extremely smooth finish.

Another grade of graphite suitable for use as the main body for permanent molds for casting superalloys, titanium, titanium alloys and titanium aluminides, nickel aluminides is isotropic fine grained graphite made by vibration molding.

Isotropic fine grained graphite is synthetic material produced by the following steps:

(1) Fine grained coke extracted from mines is pulverized, separated from ashes and purified by flotation techniques. The crushed coke is mixed with binders (tar) and homogenized.

(2) The mixture is isostatically pressed into green compacts at room temperature (3) The green compacts are baked at 1200° C. causing carbonizing and densification. The binder is converted into carbon. The baking process binds the original carbon particles together (similar to the process of sintering of metal powders) into a solid mass.

(4) The densified carbon part is then graphitized at 2600° C. Graphitization is the formation of ordered graphite lattice from carbon. The carbon from the binder around the grain boundaries is also converted into graphite. The final product is nearly 100% graphite (the carbon from the binder is all converted in graphite during graphitization).

Extruded anisotropic graphite is synthesized according to the following steps:

(1) Coarse grain coke (pulverized and purified) is mixed with pitch and warm extruded into green compacts.

(2) The green compacts are baked at 1200° C. (carbonization and densification). The binder (pitch is carbonized)

(3) The baked compact is graphitized into products that are highly porous and structurally weak. It is impregnated with pitch to fill the pores and improve the strength.

(4) The impregnated graphite is baked again at 1200° C. to carbonize the pitch.

(5) The final product (extruded graphite) contains ~90–95% graphite and ~5–10% loosely bonded carbon.

When liquid metal is poured into the graphite molds, the mold wall/melt interface is subjected to shear and compressive stresses which can fracture graphite at the interface. Any graphite particles and "loosely bonded carbon mass" plucked away from the mold wall are absorbed into the hot melt and begin to react with oxide particles in the melt and generate carbon dioxide gas bubbles. These gas bubbles coalesce and get trapped as porosity into the solidified castings. A coating of refractory metals such as W or Re or refractory metal carbides such as TaC or HfC due to its high density, near zero porosity, and high compressive and flexural strength suffers negligible mechanical damage at the mold wall/melt interface during the casting process. The castings produced in molds coated with refractory metals such as W or Re or refractory metal carbides such as TaC or HfC have excellent surface quality and mechanical integrity.

Properties of various grades of graphite that influence the quality of the castings are high strength, high density and low porosity. Key properties of isotropic graphite and extruded graphite are listed in TABLES 1 and 2.

TABLE 1

(PROPERTIES OF ISOTROPIC GRAPHITE MADE VIA ISOSTATIC PRESSING)

| Grade | Density Gm/cc | Flexural Strength (psi) | Compressive Strength (psi) | Grain Size (microns) | Thermal Conductivity (BTU/ft-hr-F) | Porosity (open) |
|---|---|---|---|---|---|---|
| R8500 | 1.77 | 7250 | 17,400 | 6 | 46 | 13% |
| R8650 | 1.84 | 9400 | 21,750 | 5 | 52 | 12% |
| R8710 | 1.88 | 12300 | 34,800 | 3 | 58 | 10% |

TABLE 2

(PROPERTIES ANISOTROPIC GRAPHITE VIA EXTRUSION)

| Grade | Density Gm/cc | Flexural Strength (psi) | Compressive Strength (psi) | Grain Size (microns) | Thermal Conductivity (BTU/ft-hr-F) | Porosity (open) |
|---|---|---|---|---|---|---|
| HLM | 1.72 | 3500 | 7500 | 410 | 86 | 23% |
| HLR | 1.64 | 1750 | 4500 | 760 | 85 | 27% |

Additional information about isotropic graphite is disclosed in U.S. patent application Ser. No. 10/143,920, filed May 14, 2002, incorporated herein by reference in its entirety.

3. Making the Mold

In accordance with a preferred embodiment of the present invention, in a first step is provided the substrate, which is the isotropic graphite mold with a machined cavity of the desired shape. The mold cavity is then coated with a 2 to 500 microns, 2 to 200 microns, 7 to 100 microns, or 10 to 25 microns thick layer of refractory metals such as W or Re or refractory metal carbides such as TaC or HfC by one of the following processes, chemical vapor deposition, plasma assisted chemical vapor deposition, sputtering and magnetron sputtering.

B. Alloys

There are a variety of superalloys.

Nickel base superalloys contain 10–20% Cr, up to about 8% Al and/or Ti, and one or more elements in small amounts (0.1–12% total) such as B, C and/or Zr, as well as small amounts (0.1–12% total) of one or more alloying elements such as Mo, Nb, W, Ta, Co, Re, Hf, and Fe. There may also several trace elements such as Mn, Si, P, S, O and N that must be controlled through good melting practices. There may also be inevitable impurity elements, wherein the impurity elements are less than 0.05% each and less than 0.15% total. Unless otherwise specified, all % compositions in the present description are weight percents.

Cobalt base superalloys are less complex than nickel base superalloys and typically contain 10–30% Cr, 5–25% Ni and 2–15% W and small amounts (0.1–12% total) of one or more other elements such as Al, Ti, Nb, Mo, Fe, C, Hf, Ta, and Zr. There may also be inevitable impurity elements, wherein the impurity elements are less than 0.05% each and less than 0.15% total.

Nickel-iron base superalloys contain 25–45% Ni, 37–64% Fe, 10–15% Cr, 0.5–3% Al and/or Ti, and small amounts (0.1–12% total) of one or more elements such as B, C, Mo, Nb, and W. There may also be inevitable impurity elements, wherein the impurity elements are less than 0.05% each and less than 0.15% total.

The invention is also advantageous for use with stainless steel alloys based on Fe primarily containing 10–30% Cr and 5–25% Ni, and small amounts (0.1–12%) of one or more other elements such as Mo, Ta, W, Ti, Al, Hf, Zr, Re, C, B and V, etc. and inevitable impurity elements, wherein the impurity elements are less than 0.05% each and less than 0.15% total.

The invention is also advantageous for use with metallic alloys based on titanium. Such alloys generally contain at least about 50% Ti and at least one other element selected from the group consisting of Al, V, Cr, Mo, Sn, Si, Zr, Cu, C, B, Fe and Mo, and inevitable impurity elements, wherein the impurity elements are less than 0.05% each and less than 0.15% total.

Suitable metallic alloys also include alloys based on titanium and aluminum known as titanium aluminides which typically contain 50–85% titanium, 15–36% Al, and at least one other element selected from the group consisting of Cr, Nb, V, Mo, Si and Zr and inevitable impurity elements, wherein the impurity elements are less than 0.05% each and less than 0.15% total.

The invention is also advantageous for use with metallic alloys based on at least 50% zirconium and which contain at least one other element selected from the group consisting of Al, V, Mo, Sn, Si, Ti, Hf, Cu, C, Fe and Mo and inevitable impurity elements, wherein the impurity elements are less than 0.05% each and less than 0.15% total.

The invention is also advantageous for use with metallic alloys based on nickel and aluminum commonly known as nickel aluminides. These alloys contain at least 50% nickel, 20–40% Al and optionally at least one other element selected from the group consisting of V, Si, Zr, Cu, C, Fe and Mo and inevitable impurity elements, wherein the impurity elements are less than 0.05% each and less than 0.15% total.

The invention is also advantageous for use with aluminum matrix composites containing 20 to 60 volume percent of hard ceramic particulate or whiskers of one or more of the compounds such as silicon carbide, aluminum oxide, titanium carbide or titanium diboride.

C. Use of the Mold

An alloy is melted by any conventional process that achieves uniform melting and does not oxidize or otherwise harm the alloy. For example, a preferred heating method is vacuum induction melting. Vacuum induction melting is a known alloy melting process as described in the following references, all of which are incorporated herein by reference:

D. P. Moon et al, ASTM Data Series DS 7-SI, 1–350 (1953).

M. C. Hebeisen et al, NASA SP-5095, 31–42 (1971).

R. Schlatter, "Vacuum Induction Melting Technology of High Temperature Alloys", Proceedings of the AIME Electric Furnace Conference, Toronto (1971).

Examples of other suitable heating processes include the "plasma vacuum arc remelting" technique and induction skull melting.

Preferably the molds are kept heated (200–800° C.) in the mold chamber of the vacuum furnace prior to the casting of melt in the molds. This heating is particularly important for casing complex shapes. The molds can be also kept at ambient temperatures for casting simple shapes. Typical preferred ranges for keeping the molds heated are between 150 and 800° C., between 200 and 800° C., between 150 and 450° C., and between 250 and 450° C.

The candidate iron, nickel and cobalt base superalloys are melted in vacuum by an induction melting technique and the liquid metal is poured under full or partial vacuum into the heated or unheated graphite mold. In some instances of partial vacuum, the liquid metal is poured under a partial pressure of inert gas. The molding then occurs under full or partial vacuum.

High purity and high density of the composite mold material of the present invention enhances non-reactivity of the mold surface with respect to the liquid melt during solidification. As a consequence, the process of the present invention produces a casting having a very smooth high quality surface as compared to the conventional ceramic mold investment casting process. The molds coated with a thin layer of dense and hard coating of refractory metals such as W or Re or refractory metal carbides such as TaC or HfC show very little reaction with molten superalloys, titanium alloys and stainless steels and suffer minimal wear and erosion after use and hence, can be used repeatedly over many times to fabricate castings of the said alloys with high quality. Whereas the conventional investment casting molds are used one time for fabrication of superalloy, stainless steel, titanium and titanium aluminide alloy castings. The present invention is particularly suitable for fabricating highly alloyed nickel, cobalt and iron base superalloys, titanium alloys and titanium aluminide alloys which are difficult to fabricate by other processes such as forging or machining. Such alloys can be fabricated in accordance with the present invention as near net shaped or net shaped components thereby minimizing subsequent machining operations.

According to an embodiment of the present invention, titanium alloys and titanium aluminide alloys are induction melted in a water cooled copper crucible or yttrium oxide crucible and are cast in high density, high strength ultrafine grained isotropic graphite molds coated with refractory metals such as W or Re or refractory metal carbides such as TaC or HfC.

Furthermore, titanium alloys can be melted in a water-cooled copper crucible via the "plasma vacuum arc remelting" technique. The castings are produced with high quality surface and dimensional tolerances free from casting defects and contamination. Use of the casting process according to the present invention eliminates the necessity of chemical milling to clean the contaminated surface layer on the casting as commonly present in titanium castings produced by the conventional investment casting method. Since the graphite molds coated with refractory metals such as W or Re or refractory metal carbides such as TaC or HfC. do not react with the titanium melt and show no sign of erosion and damage, the molds can be used repeatedly numerous times to lower the cost of production. Superalloys, titanium alloys and titanium aluminide alloys, zirconium alloys and nickel aluminide alloys fabricated as castings by the process as described in the present invention will find applications as jet engine parts and other high technology components requiring improved performance capabilities.

According to the present invention, during the casting process the mold can be subjected to centrifuging. As a consequence of the centrifuging action, molten alloy poured into the mold will be forced from a central axis of the equipment into individual mold cavities that are placed on the circumference. This provides a means of increasing the filling pressure within each mold and allows for reproduction of intricate details.

Another teaching of the present invention involves a method of producing tubular products of superalloys and other metallic alloys as mentioned in the previous paragraphs of this application. This process is based on vacuum centrifugal casting of the selected alloys in molten state in an isotropic graphite mold coated with refractory metals such as W or Re or refractory metal carbides such as TaC or HfC, whereby the mold is rotated about its own axis.

Centrifugal castings are produced by pouring molten metal into the graphite mold which is coated with refractory metals such as W or Re or refractory metal carbides such as TaC or HfC and is being rotated or revolved around its own axis during the casting operation.

The axis of rotation may be horizontal or inclined at any angle up to the vertical position. Molten metal is poured into the spinning mold cavity and the metal is held against the wall of the mold by centrifugal force. The speed of rotation and metal pouring rate vary with the alloy and size and shape being cast.

The inside surface of a true centrifugal casting is always cylindrical. In semi-centrifugal casting, a central core is used to allow for shapes other than a true cylinder to be produced on the inside surface of the casting.

The uniformity and density of centrifugal castings is expected to approach that of wrought material, with the added advantage that the mechanical properties are nearly equal in all directions. Directional solidification from the outside surface contacting the mold will result in castings of exceptional quality free from casting defects.

Additional background on centrifugal casting is presented in U.S. Provisional Patent Application No. 60/296,770 filed on Jun. 11, 2001 and U.S. Pat. No. 6,634,413 to Ray et al., filed Jun. 7, 2002, both of which are incorporated herein by reference in their entirety.

VII. Parameters

Where applicable, parameters of properties listed in the present application are measured by the below listed standards unless otherwise indicated.

Compressive strength is measured by ASTM C-695.

Flexural strength is measured by ASTM C 651.

Thermal conductivity is measured according to ASTM C-714.

Porosity is measured according to ASTM C-830.

Shear strength is measured according to ASTM C273, D732.

Shore hardness is measured according to ASTM D2240.

Grain size is measured according to ASTM E 112.

Coefficient of thermal expansion is measured according to E 831.

Density is measured according to ASTM C838-96.

Oxidation threshold is measured according ASTM E 1269-90.

Vickers microhardness in HV units is measured according to ASTM E 384.

VIII. EXAMPLES

Example 1

TABLE 3 lists various nickel, cobalt and iron base superalloys that are suitable candidates to be fabricated as castings with high integrity and quality under vacuum in isotropic graphite molds coated with refractory metals such as W or Re or refractory metal carbides such as TaC or HfC.

The molds for performing experiments according to the present invention are made with isostatically pressed isotropic graphite having a machined mold cavity coated with refractory metals such as W or Re or refractory metal carbides such as TaC or HfC. Some identical experiments are performed with molds made with extruded anisotropic graphite and similarly coated. The objective is to demonstrate the difference in the quality of castings made with different grades of graphite. The isotropic graphite and extruded graphite required for conducting the experiments can be procured, for example, from SGL Carbon Group. The coatings of refractory metals such as W or Re or refractory metal carbides such as TaC or HfC can be deposited on the mold cavity of graphite by one of the following processes: chemical vapor deposition, plasma assisted chemical vapor deposition, sputtering and magnetron sputtering.

TABLE 3

(compositions are in weight %)

| Alloy | Ni | Cr | Co | Mo | W | Fe | C | Ta + Nb | Al | Ti | Si | Others |
|---|---|---|---|---|---|---|---|---|---|---|---|---|
| IN 738 | 63 | 16 | 8.5 | 1.75 | 2.6 | 0.5 | 0.13 | 2.6 | 3.45 | 3.45 | 0.2 | 0.1 Hf |
| Rene 80 | 60.5 | 14 | 9.5 | 4.0 | 4.0 | 0.17 | | 3.0 | 5.0 | | | 0.03 Zr 0.15 B |
| Mar-M247 | 60 | 8.25 | 10 | 0.7 | 10 | | 0.15 | 3.0 | 5.5 | 1.0 | | 1.5 Hf 0.15 B 0.05 Zr |
| PWA 795 | 14.03 | 19.96 | 46.4 | | 9.33 | | 0.35 | 2.89 | 4.4 | 0.18 | 0.17 | 1.14 Hf 0.02 Zr 0.07 Y |
| Rene 142 | 57.4 | 6.89 | 11.90 | 1.47 | 5.03 | | 0.12 | 6.46 | 6.25 | 0.005 | 0.012 | 2.76 Re 1.54 Hf 0.017 Zr 0.018 B |
| Mar-M200 | 59 | 9.0 | 10.0 | | 12.5 | 1.5 | 0.15 | 1.0 | 5.0 | 2.0 | | 0.015 B 0.05 Zr |
| FSX 414 | 10 | 29 | 53.08 | | 7.0 | | 0.12 | | | | 0.8 | |
| IN939 | 48.33 | 22.5 | 19 | | 2.0 | | 0.16 | 1.35 | 1.85 | 3.8 | | 0.005 B 0.01 Nb |
| IN792 | 61 | 12.5 | 9.0 | 1.9 | 4.15 | 0.5 | 0.1 | 4.65 | 3.35 | 3.95 | 0.2 | |
| Mar M918 | 19 | 19 | 54.56 | | | 0.5 | 0.04 | 7.0 Ta | | | | |
| Mar-M509 | 10 | 23.5 | 55 | | 7.0 | | 0.60 | 3.5 | | 0.2 | | 0.5 Zr |
| Alloy 1957 | 69.9 | 21.67 | 0.009 | | | | 0.012 | 2.63 | | 0.57 | 0.43 | 1.98 Pd |
| Pmet 920 | 43.45 | 20 | 13.5 | 1.5 | 15.50 | | 0.045 | 4.2 Ta | 0.80 | | 0.40 | 0.60 Mn |
| Alloy 1896 | 60.23 | 14 | 9.5 | 1.55 | 3.8 | 0.10 | | 2.8 Ta | 3.0 | 4.9 | | 0.035 Zr 0.005 B |
| 501SS | | 7.0 | | 0.55 | | 92.33 | 0.12 | | | | | |
| SS316-GD | 11.65 | 16.33 | 2.2 | | 66.65 | | | | | | 0.1 | 0.4 Gd 1.7 Mn |

Typical shapes of castings which can be fabricated are as follows:

(1) 1 inch diameter×25 inches long (2) ½ inch diameter×25 inches long (3) ¼ inch diameter×25 inches long (4) ½ inch×2 inch×2 inch long (5) 10 inch diameter×1 inch thick.

For example, several of the alloys listed in TABLE 3 such as IN 738, Rene 142, PWA 795 and PMet 920 can typically be vacuum melted and cast as 1 inch diameter×25 inch long bars in isotropic graphite molds coated with refractory metals such as W or Re or refractory metal carbides such as TaC or HfC. Such cast bars will have excellent surface quality free from casting defects.

On the contrary, when molds made of extruded anisotropic graphite (i.e., HLM and HLR grades) and similarly coated were employed, the quality of the cast bars (1 inch diameter) of the alloys listed in TABLE 5 was found to be poor. The bar surfaces showed evidence of casting defects (surface irregularities, cavities, pits and gas holes). There was evidence of some interaction of the mold surface with the melt causing mold wear. The extruded graphite has low density and, low strength and large amount of porosity compared to the isotropic graphite.

Consequently, the machined surfaces of the extruded graphite molds are less smooth and the coatings of W, Re, TaC or HfC on extruded graphite molds spall off in contact with the high temperature melts during the casting operation. Castings made in such molds tend to exhibit inferior surface quality compared to those made in isotropic graphite molds coated with refractory metals such as W or Re or refractory metal carbides such as TaC or HfC. Furthermore, due to rapid erosion of mold surface in contact with molten metal during the casting process, the extruded mold deteriorates so much after it is used a few times, i.e., 2 or 3 times, that the quality of castings becomes unacceptable.

Example 2

Titanium and Titanium Aluminide Castings

The major use of titanium castings is in the aerospace, chemical and energy industries. The aerospace applications generally require high performance cast parts, while the chemical and energy industries primarily use large castings where corrosion resistance is a major consideration in design and material choice.

Titanium alloys and titanium aluminide alloys are induction melted in a water cooled copper crucible or yttrium oxide crucible and cast in high density isotropic graphite molds coated with refractory metals such as W or Re or refractory metal carbides such as TaC or HfC. The castings have high quality surface and precise dimensional tolerances free from casting defects such as a brittle alpha casing on the outer surface of the castings as well as inclusions. Furthermore, the hard coating of refractory metals such as W or Re or refractory metal carbides such as TaC or HfC prevents any reaction of molten titanium with the mold walls. Use of the casting process according to the present invention eliminates the necessity of chemical milling to clean the contaminated surface layer on the casting as commonly present in titanium castings produced by the conventional investment casting method. Since the isotopic graphite molds coated with refractory metals such as W or Re or refractory metal carbides such as TaC or HfC do not react with the titanium melt and show no sign of erosion and damage, the molds can be used repeatedly numerous times to lower the cost of production.

TABLES 4 and 5 list several titanium and titanium aluminide alloys which can be processed into castings of high quality in isotropic graphite molds coated with refractory metals such as W or Re or refractory metal carbides such as TaC or HfC in accordance with the present invention.

TABLE 4

(Titanium alloys)

| Alloy | Composition (wt %) | | | | | | | | | |
|---|---|---|---|---|---|---|---|---|---|---|
| No. | Ti | Al | V | Sn | Fe | Cu | C | Zr | Mo | Other |
| 1 | Bal | 6.0 | 5.05 | 2.15 | 0.60 | 0.55 | 0.03 | | | |
| 2 | Bal | 3.0 | 10.3 | 2.1 | | | 0.05 | | | |
| 3 | Bal | 5.5 | | 2.1 | | | | 3.7 | 0.3 | |
| 4 | Bal | 6.2 | | 2.0 | | | | 4.0 | 6.0 | |
| 5 | Bal | 6.2 | | 2.0 | | | | 2.0 | 2.0 | 2.0 Cr 0.25 Si |
| 6 | Bal | 5.0 | | 2.25 | | | | | | |
| 7 | Bal | 2.5 | 13 | 7.0 | | | | 2.0 | | |
| 8 | Bal | 3.0 | 10 | | 2 | | | | | |
| 9 | Bal | 3 | 15 | 3 | | | | | | 3.0 Cr |
| 10 | Bal | | | 4.5 | | | | 6 | 11.5 | |

TABLE 5

(Titanium aluminum alloys)

| Alloy | Composition (wt %) | | | | |
|---|---|---|---|---|---|
| No. | Ti | Al | Nb | V | Other |
| 1 | Bal | 14 | 21 | | |
| 2 | Bal | 18 | 3 | 2.7 | |
| 3 | Bal | 31 | 7 | 1.8 | 2.0 Mo |
| 4 | Bal | 24 | 15 | | |
| 5 | Bal | 26 | 12 | | |
| 6 | Bal | 25 | 10 | 3.0 | 1.5 Mo |

It should be apparent that in addition to the above-described embodiments, other embodiments are also encompassed by the spirit and scope of the present invention. Thus, the present invention is not limited by the above-provided description, but rather is defined by the claims appended hereto.

What is claimed is:

1. A method of making cast shapes of a metallic alloy, comprising the steps of:

melting the alloy to form a melt under vacuum or partial pressure of inert gas;

pouring the melt of the alloy into a cavity of a composite mold comprising a substrate of isotropic graphite having a mold cavity, wherein the surface of the mold cavity is coated with a coating of a refractory metal such as W or Re or a refractory metal carbide such as TaC or HfC having a thickness from 2 to 500 microns, and wherein the graphite of the substrate of the mold has isotropic grains with grain size between 3 and 10 microns, flexural strength between about 7,000 and 20,000 psi, compressive strength between about 12,000 and 35,000 psi, and porosity below about 13%; and solidifying the melted alloy into a body taking the shape of the mold cavity.

2. The method of claim 1, wherein the cavity is a machined cavity and the coating of a refractory metal such as W or Re or a refractory metal carbide such as TaC or HfC is deposited on the surface of the machined cavity via either chemical vapor deposition or plasma assisted chemical vapor deposition, or sputtering.

3. The method of claim 1, wherein the thickness of the coating of a refractory metal such as W or Re or a refractory metal carbide such as TaC or HfC on the surface of the cavity of the mold is from 2 to 200 microns.

4. The method of claim 1, wherein the thickness of the coating of a refractory metal such as W or Re or a refractory metal carbide such as TaC or HfC on the surface of the cavity of the mold is from 7 to 100 microns.

5. The method of claim 1, wherein the thickness of the coating of a refractory metal such as W or Re or a refractory metal carbide such as TaC or HfC on the surface of the cavity of the mold is from 10 to 25 microns.

6. The method of claim 1, wherein the mold is at a temperature between 100 and 800° C. just prior to pouring the melt into the mold.

7. The method of claim 1, wherein the mold is at a temperature between 150 and 800° C. just prior to pouring the melt into the mold.

8. The method of claim 1, wherein the mold is at a temperature between 200 and 800° C. just prior to pouring the melt into the mold.

9. The method of claim 1, wherein the mold is at a temperature between 150 and 450° C. just prior to pouring the melt into the mold.

10. The method of claim 1, wherein the mold is at a temperature between 250 and 450° C. just prior to pouring the melt into the mold.

11. The method of claim 1, wherein the metallic alloy is selected from the group consisting of a nickel base superalloy, nickel-iron base superalloy and cobalt base superalloy.

12. The method of claim 1, wherein the metallic alloy is a nickel base superalloy containing 10–20% Cr, at most about 8% total of at least one element selected from the group consisting of Al and Ti, 0.1–12% total of at least one element selected from the group consisting of B, C and Zr, 0.1–12% total of at least one alloying element selected from the group consisting of Mo, Nb, W, Ta, Co, Re, Hf, and Fe, and inevitable impurity elements, wherein the impurity elements are less than 0.05% each and less than 0.15% total.

13. The method of claim 1, wherein the metallic alloy is a cobalt base superalloy containing 10–30% Cr, 5–25% Ni and 2–15% W and 0.1–12% total of at least one other element selected from the group consisting of Al, Ti, Nb, Mo, Fe, C, Hf, Ta, and Zr, and inevitable impurity elements, wherein the impurity elements are less than 0.05% each and less than 0.15% total.

14. The method of claim 1, wherein the metallic alloy is a nickel-iron base superalloy containing 2545% Ni, 37–64% Fe, 10–15% Cr, 0.5–3% total of at least one element selected from the group consisting of Al and Ti, 0.1–12% total of at least one element selected from the group consisting of B, C, Mo, Nb, and W, and inevitable impurity elements, wherein the impurity elements are less than 0.05% each and less than 0.15% total.

15. The method of claim 1, wherein the metallic alloy is a stainless steel alloy based on Fe, containing 10–30% Cr and 5–25% Ni, and 0.1–12% total of at least one element selected from the group consisting of Mo, Ta, W, Ti, Al, Hf, Zr, Re, C, B and V, and inevitable impurity elements, wherein the impurity elements are less than 0.05% each and less than 0.15% total.

16. The method of claim 1, wherein the metallic alloy is based on titanium and contains at least about 50% Ti and at least one other element selected from the group consisting of Al, V, Cr, Mo, Sn, Si, Zr, Cu, C, B, Fe and Mo, and inevitable impurity elements, wherein the impurity elements are less than 0.05% each and less than 0.15% total.

17. The method of claim 1, wherein the metallic alloy is titanium aluminide based on titanium and aluminum and containing 50–85% titanium, 15–36% Al, and at least one other element selected from the group consisting of Cr, Nb, V, Mo, Si and Zr, and inevitable impurity elements, wherein the impurity elements are less than 0.05% each and less than 0.15% total.

18. The method of claim 1, wherein the metallic alloy containing at least 50% zirconium and at least one other element selected from the group consisting of Al, V, Mo, Sn, Si, Ti, Hf, Cu, C, Fe and Mo and inevitable impurity elements, wherein the impurity elements are less than 0.05% each and less than 0.15% total.

19. The method of claim 1, wherein the metallic alloy is nickel aluminide containing at least 50% nickel, 20–40% Al and optionally at least one other element selected from the group consisting of V, Si, Zr, Cu, C, Fe and Mo and inevitable impurity elements, wherein the impurity elements are less than 0.05% each and less than 0.15% total.

20. The method of claim 1, wherein the metallic alloy is a castable aluminum metal matrix composite based on an aluminum alloy which is reinforced with 20 to 60 volume percent of whiskers or particulates of at least one compound selected from the group consisting of silicon carbide, aluminum oxide, titanium carbide and titanium boride.

21. The method of claim 1, wherein the alloy is melted by a method selected from the group consisting of vacuum induction melting and plasma arc remelting.

22. The method of claim 1, wherein the mold is cylindrical and rotated at high speeds between 50 to 3000 RPM around its own axis during the casting process.

23. The method of claim 1, wherein the substrate of the composite mold has been isostatically or vibrationally molded.

24. The method of claim 1, wherein the isotropic graphite which constitutes the substrate of the mold has a density between about 1.77 and 1.9 grams/cc and compressive strength between about 17,000 and 35,000 psi.

25. The method of claim 1, wherein the substrate of the mold has been made by machining from isotropic graphite which has been isostatically or vibrationally molded.

26. The method of claim 1, wherein the coatings of the refractory metal such as W or Re or refractory metal carbide such as TaC or HfC have Vickers Hardness between 2200 and 3500 HV.

* * * * *